US005249402A

United States Patent [19]

Crick et al.

[11] Patent Number: 5,249,402

[45] Date of Patent: Oct. 5, 1993

[54] DECORATIVE WALL COVERING

[76] Inventors: Dallas M. Crick, 1000 SW. 66th Ave., Pembroke Pines, Fla. 33023; James G. Perkins, Waterways Spinnaker Bay, 21085 NE. 34th Ave., Suite 405, Miami, Fla. 33180; Douglas F. Hudson, Jr., 820 Belle Meade Island Dr., Miami, Fla. 33138

[21] Appl. No.: 682,672

[22] Filed: Apr. 9, 1991

[51] Int. Cl.[5] ..... E04D 1/00

[52] U.S. Cl. ..... 52/533; 52/555; 52/539; 52/553; 52/520; 52/546

[58] Field of Search ..... 52/314, 539, 536, 533, 52/520, 521, 555, 553, 546, 535

[56] References Cited

U.S. PATENT DOCUMENTS

| | | | |
|---|---|---|---|
| 3,160,245 | 5/1960 | Pavlecka . | |
| 3,217,453 | 11/1965 | Medow . | |
| 3,233,382 | 2/1966 | Gravely . | |
| 3,296,759 | 1/1967 | Pavlecka . | |
| 3,304,667 | 2/1967 | Donegan . | |
| 3,363,380 | 1/1968 | Merrill . | |
| 3,485,002 | 12/1969 | Baker . | |
| 3,605,369 | 9/1971 | Merrill et al. . | |
| 3,613,326 | 10/1971 | Mollman . | |
| 3,667,184 | 6/1972 | Merrill et al. . | |
| 3,686,813 | 8/1972 | Breitweiser et al. . | |
| 3,754,366 | 8/1973 | Jansson et al. . | |
| 3,837,133 | 9/1974 | Mollman . | |
| 3,899,855 | 8/1975 | Gadsby . | |
| 3,927,501 | 12/1975 | Allen et al. . | |
| 4,015,391 | 4/1977 | Epstein et al. . | |
| 4,107,885 | 8/1978 | Lindal . | |
| 4,251,967 | 2/1981 | Hoofe, III . | |
| 4,327,528 | 5/1982 | Fritz | 52/533 |
| 4,343,126 | 8/1982 | Hoofe, III . | |
| 4,423,572 | 1/1984 | Tor . | |
| 4,435,938 | 3/1984 | Rutkowski et al. . | |
| 4,459,788 | 7/1984 | Bockwinkel . | |
| 4,468,909 | 9/1984 | Eaton . | |
| 4,476,661 | 10/1984 | Hoofe, III . | |
| 4,522,002 | 6/1985 | Davis et al. . | |
| 4,586,304 | 5/1986 | Flamand . | |
| 4,598,522 | 7/1986 | Hoofe, III . | |
| 4,680,911 | 7/1987 | Davis et al. . | |
| 4,731,970 | 3/1988 | Marshall et al. . | |
| 5,072,562 | 12/1991 | Crick et al. | 52/533 |
| 5,076,037 | 12/1991 | Crick et al. | 52/520 |

*Primary Examiner*—Carl D. Friedman
*Assistant Examiner*—Winnie Yip
*Attorney, Agent, or Firm*—Leydig, Voit & Mayer

[57] ABSTRACT

A wall covering comprising a plurality of plastic molded panels each having a relatively thin body portion formed with rows of simulated shake shingles. The panels are mounted on a support surface, such as a wall or roof, in a plurality of vertically spaced horizontal courses with a lower marginal edge region of the panels in one course overlapping and sealingly engaging the upper marginal edge regions of the panels in the course immediately below and with side marginal edge regions of adjacent panels overlapping in sealing engagement. The side marginal edge regions of each panel are formed with a plurality of vertically spaced integrally formed hooks depending from the underside thereof for snap action insertion through respective hook receiving apertures formed in the underlying side marginal edge region of the adjacent panel for maintaining the overlapping marginal edge regions of the panels in engaged relation. The panels each have a rectangular reinforcing and support grid integrally formed on the underside thereof for facilitating handling and mounting.

32 Claims, 4 Drawing Sheets

DECORATIVE WALL COVERING

RELATED APPLICATIONS

1. Crick et al. U.S. application Ser. No. 07/487,910 on Decorative Wall Covering filed Mar. 5, 1990.

2. Crick et al. U.S. application Ser. No. 07/488,351 on Decorative Wall Cover And Method Of Installation filed Mar. 2, 1990.

FIELD OF THE INVENTION

The present invention relates generally to roof and wall coverings primarily intended for outdoor usage, and more particularly, to roof and wall coverings comprised of relatively large panels which each are molded or otherwise formed with decorative patterns characteristic of conventional roofing and siding materials such as shake, tile, brick or the like.

BACKGROUND OF THE INVENTION

Various synthetic roof and wall coverings are known today, such as those formed of elongated thermoplastic panels that are nailed to the wall or roof support surface in horizontal courses or rows in partially overlapping relation to each other so as to provide a substantially water resistant, protective layer over the support surface. While it is desirable that the panels facilitate drainage of rain water and the like to which they are exposed in the outside environment, heretofore this has presented problems. Because of the surface tension of water, capillary action often causes water to be drawn inwardly between overlapping marginal edge portions of adjacent panels and enter the space beneath the panels, either through nail holes or about the peripheral edges of the panels, becoming trapped under the panels. Such capillary water movement worsens during high wind and storm conditions. Not only does the trapped moisture under the panels increase the possibility for leakage and damage to the wall or roof, but upon freezing, the expanding moisture tends to lift the overlapping edge portions, further breaking the protective barrier between the panels and the support surface.

The above identified Crick et al. applications Ser. Nos. 07/487,910 and 07/488,351, disclose synthetic wall and roof panels formed with water barrier ridges that impede capillary movement of water between overlapping marginal edge portions of adjacent panels and facilitate drainage. Since such panels are made of plastic and are relatively large in size, typically having a length of 48 inches or more, the panels tend to easily bend and deform upon handling and upon mounting on even slightly irregular wall and roof surfaces, which often occurs when the panels are being used as a replacement covering on an existing wall or roof. Deformation and bending of the panels, either as a result of mounting or because of exposure to severe weather conditions, can destroy peripheral seals between panels and permit leakage onto the support surface, notwithstanding the water barrier and drainage ridges.

OBJECT AND SUMMARY OF THE INVENTION

It is an object of the present invention to provide a wall and roof panel that is adapted for positive interlocking engagement along its peripheral sides for maintaining a peripheral sealed condition between overlapping marginal edge portions of the panels, even when mounted on slightly irregular wall and roof support surfaces or when exposed to severe weather conditions.

Another object is to provide a synthetic wall and roof panel that has improved structural rigidity which tends to prevent bending and deformation during handling and upon mounting, and hence, further resists breakage or interruption of peripheral seals.

A further object is to provide a wall and roof panel of the foregoing type which is relatively simple in construction and which lends itself to economical manufacture and ease of installation.

Other objects and advantages o the invention will become apparent upon reading the following detailed description and upon reference to the drawings, in which:

Figure 1:
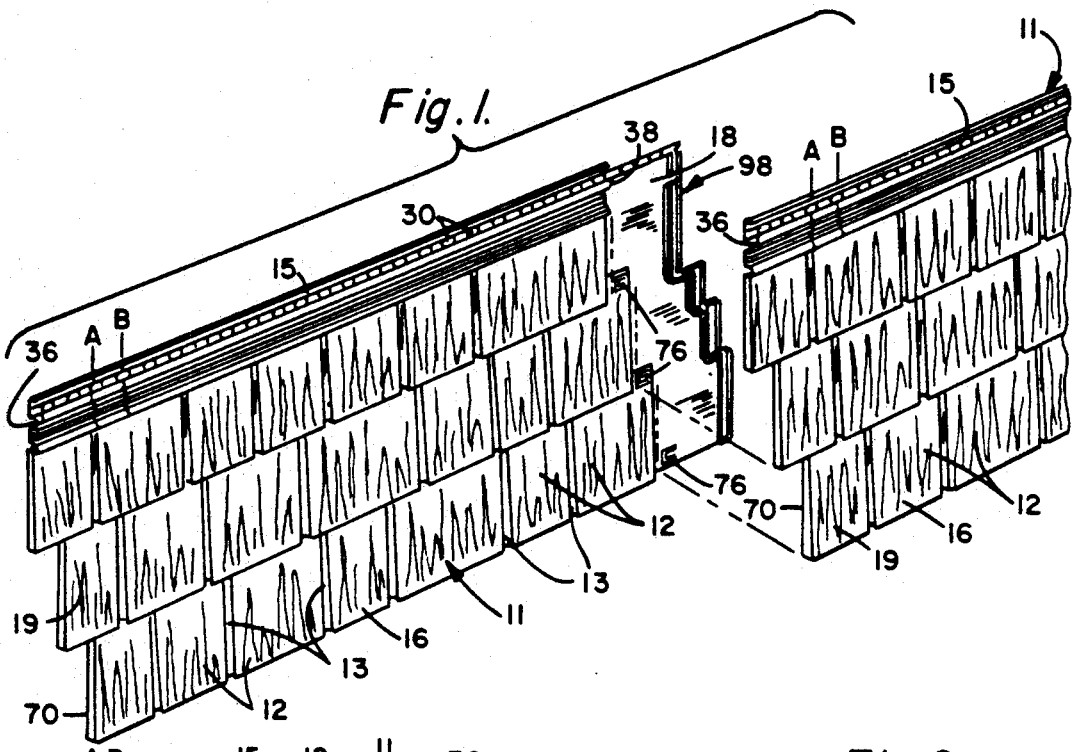
FIG. 1 is a perspective of a pair of panels that form the wall covering of the present invention, with one panel shown in exploded or separated relation to the other.
Figure 2:
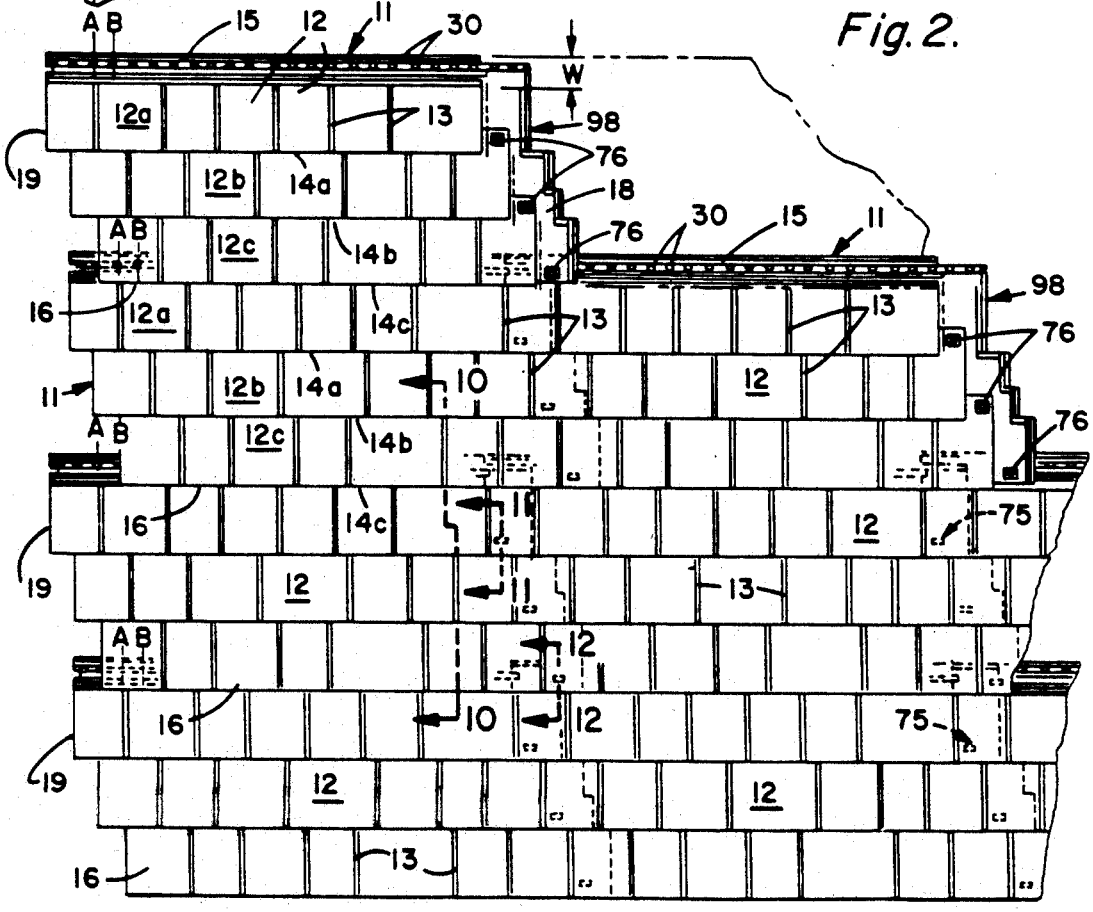
FIG. 2 is a plan view of several courses or rows of the panels which comprise the illustrated wall covering, shown in assembled relation to each other.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to the drawings, there is shown an illustrative wall covering 10 comprising a plurality of panels 11 each embodying the present invention. The panels 11, which preferably are molded out of relatively thin rigid plastic material, each are formed with simulated building elements. In this instance, the panels 11 are formed with simulated shake 12 of irregular width which are disposed in a plurality of parallel rows **12*a*, 12*b* and 12*c*, with adjacent shake 12 in each row being separated by a small gap 13. The illustrated simulated shake pattern is of a type known in the industry as "perfection" shake, wherein the lower edges 14*a*, 14*b*, 14*c* of each row 12*a*, 12*b*, 12*c* are in a substantially straight line. It will be understood that the panels 11** could be formed with other forms of simulated cedar shake shingles, or other types of building materials, such as tile, brick and the like.

Each panel 11 has an upper horizontal marginal edge region 15 having a substantially uniform width w extending across the top of the panel immediately above the top row 12*a* of shake 12, a lower marginal edge region 16 which defines a lower peripheral edge of the panel, a side marginal edge region 18 of non-uniform but generally similar width as the upper marginal edge region 15, and in this instance, located to the right-hand side of the last simulated shake 12 in each row 12*a*, 12*b*, and 12*c*, and a marginal edge region 19 on the opposite side of the panel 11 which defines a left-side peripheral edge immediately adjacent the first simulated shake of each row 12*a*, 12*b*, 12*c*. The panels 11 are mounted on a support surface 25, which may be a wall or roof of a house or other building structure, in horizontal courses with the right-side marginal edge region 18 in underlying relation to the left-side marginal edge region 19 of the panel immediately to the right thereof and with the lower marginal edge region 16 of the panels in each course overlying the upper marginal edge region 15 of the panels in the course immediately below.

The panels 11 preferably are mounted beginning with the left-hand panel of the lowermost course to be installed on the wall or roof, as is known in the art. The first panel in each course typically is cut at a different location along a left-hand side thereof in order that the simulated shake 12 of each course are offset with respect to the simulated shake of the panel in the course below so as to enhance the natural appearance of the wall covering. The panels 11 in this instance each have two predetermined cutting lines A, B along which the panels alternatively may be cut to start alternate courses as disclosed in the above identified Crick et al. application Ser. No. 07/488,35.

Figure 3:
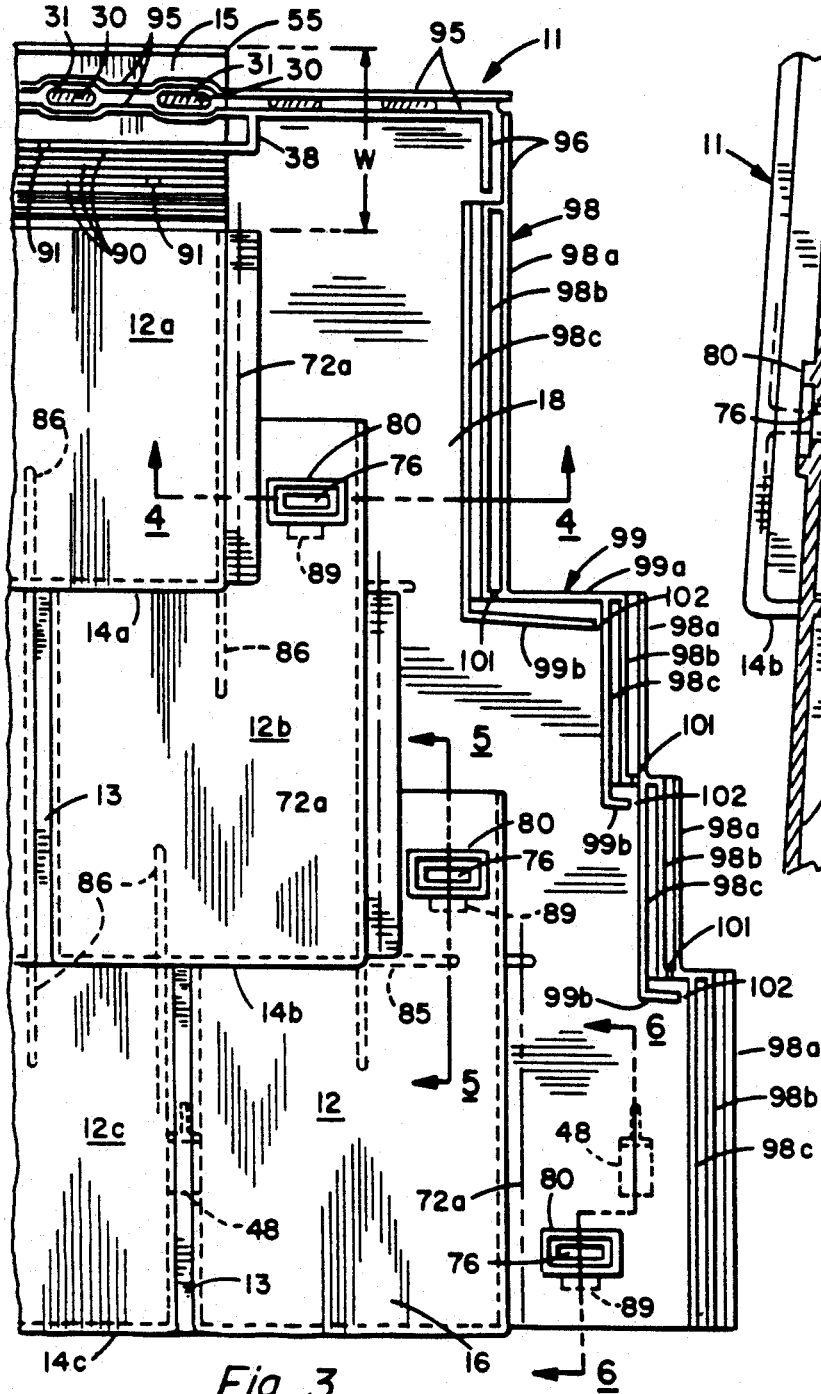
FIG. 3 is an enlarged plan view of the face side of a right-hand portion of one of the panels of the illustrated wall covering.
Figure 5:
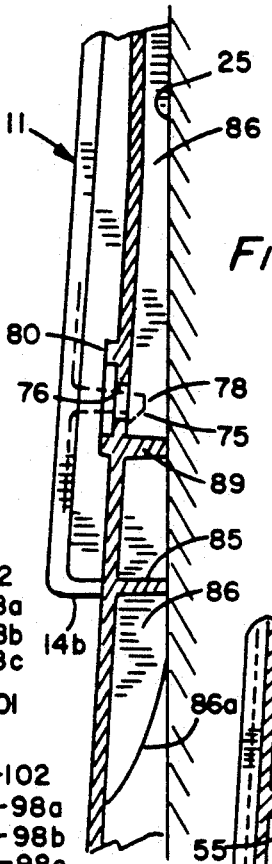
FIGS. 4–6 are enlarged fragmentary sections taken in the planes of lines 4—4, 5—5, and 6—6, respectively, in FIG. 3.
Figure 6:
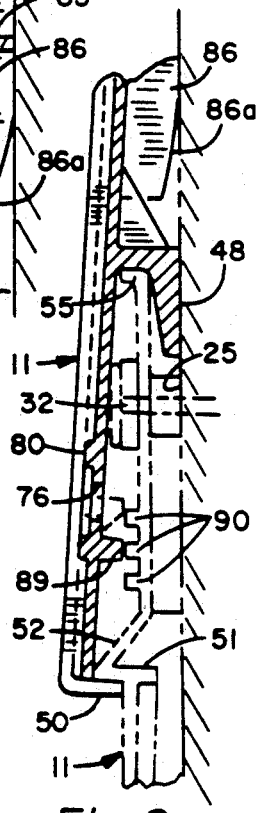

For securing the panels 11 to the support surface 25, the upper marginal edge region 15 of each panel is formed with a plurality of elongated laterally spaced nailing apertures 30. To enhance the water barrier features of the wall covering 10, the nailing apertures 30 preferably are covered with a thin plastic flashing 31 during the molding process (FIG. 3). Upon nailing each panel 11 to the support surface 25, the nail 32 will pierce the flashing 31, with the flashing 31 maintaining a relatively tight seal about the nail. Since the flashing 31 is relatively thin, such as on the order of .010 inch, it will allow horizontal expansion and retraction of the panel 11 as occurs during normal temperature variations in the outdoor environment.

Figure 7:
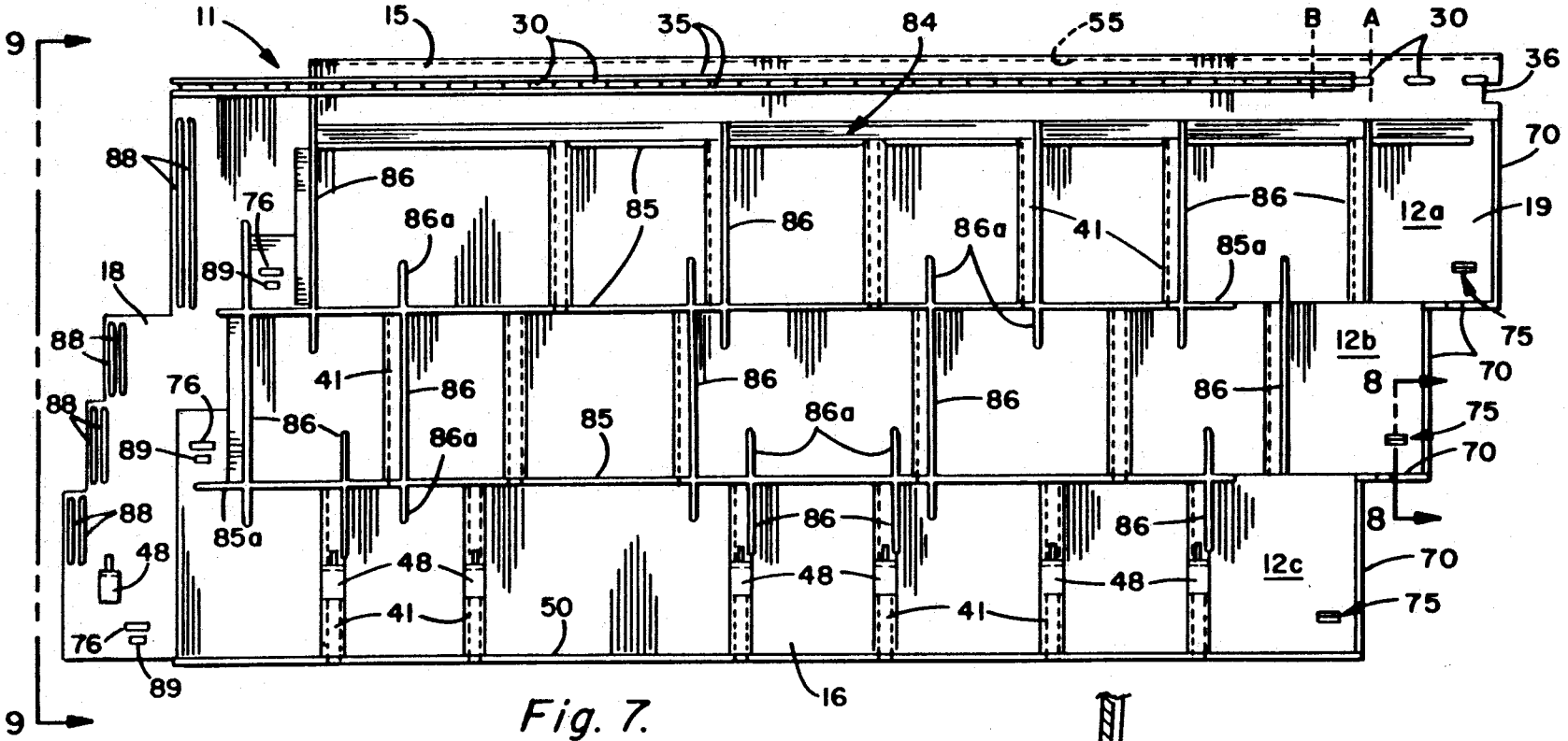
FIG. 7 is a rear side plan view of one of the illustrated panels.
Figure 8:
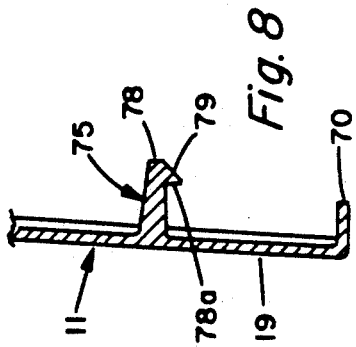
FIG. 8 is an enlarged fragmentary section taken in the plane of line 8—8 in FIG. 7.
Figure 12:
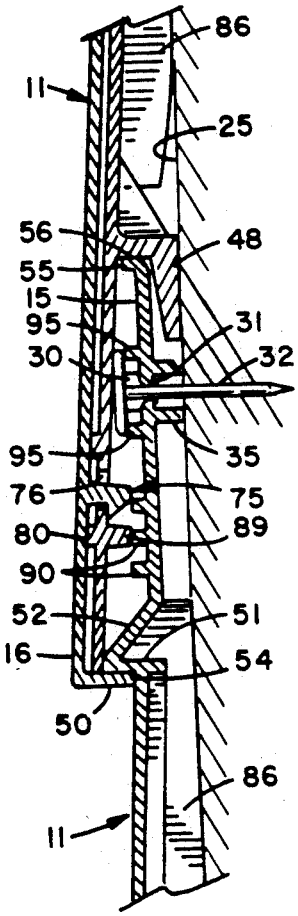

For providing firm support for the mounted panels on the wall and roof during nailing and for establishing a seal between the rear side of the panel 11 and the support surface 25, the upper marginal edge region 15 is formed with a pair of rearwardly extending horizontal sealing flanges 35 which extend substantially the length of the upper marginal edge region 15 on opposite top and bottom sides of the nailing apertures 30 (FIGS. 7 and 12). Once the upper marginal edge region 15 is nailed to the support surface, the horizontal sealing flanges 35 are maintained firmly against the support surface 25 and cannot be lifted from the support surface even during severe weather conditions.

To facilitate horizontal alignment of the panels 11 during mounting of each course, the upper marginal edge region 15 of each panel is formed with an outwardly opening, generally rectangular configured locating slot 36 on the left-hand side thereof which is positionable onto a raised, generally rectangular locating lug 38 formed on the top right-hand side of the upper marginal edge region 15 of the previously mounted panel (FIGS. 3 and 7). The left-side marginal edge region 19 preferably is positionable onto the right-side marginal edge region 18 of the adjacent panel such that an expansion space or gap, on the order ¼ inch, remains between the end of the locating lug 38 and the end of the locating slot 36.

In order to enable mounting of the panels 11 in side-by-side relation with the junctures between adjacent panels less noticeable to the eye, the rows 12*a*, 12*b*, 12*c* of shake 12 of each panel 11 extend in offset relation to each other so as to define stepped left and right-hand sides of the panel. In the illustrated embodiment, the middle row 12*b* of shake extends farther to the right than the first row 12*a* a distance corresponding to about one-quarter to one-half the width of one shake 12, and the bottom row 12*c* extends farther to the right than the middle row 12*b* about a similar distance. Hence, the right and left-side marginal edge regions 18, 19 of the panels similarly are stepped.

For interlocking the lower marginal edge region 16 of each panel to the upper marginal edge region 15 of the panel nailed to the support surface 25 immediately below, the underside of each panel has a plurality of integrally formed, laterally spaced, downwardly directed hooks 48 adapted for engaging the upper peripheral edges of the panels in the course below. The hooks 48 in this instance extend rearwardly from ridges 41 defined on the underside of the panel by the gaps 13 between the shake 12.

For properly positioning the lower marginal edge region 16 of one panel in overlapping relation to the upper marginal edge region 15 of the panel immediately therebelow, the bottom peripheral edge of each panel is in the form of a downwardly turned lip 50 that is positionable against an upwardly directed locating ledge 51 formed on the face side of the upper marginal edge region 15 of the underlying panel adjacent the upper edges of the top row 12*a* of simulated shake 12. Upon mounting of the panel 11, the lower peripheral edge of the lower row 14*c* of simulated shake 12 is disposed above the upper peripheral edge of the top row 12*a* of simulated shake of the panel immediately therebelow, again simulating the appearance of overlapping natural shake. To prevent the downwardly turned peripheral lip 50 of the upper panel from catching on the locating ledge 51 of the lower panel during mounting, the upper side of the locating ledge 51 is in the form of an inclined ramp 52 which will tend to guide the bottom peripheral lip 50 over the locating ledge 51 into proper position during installation.

For establishing seals between the overlapping bottom marginal edge region 16 of one panel and the upper marginal edge region 15 of the panel in the course immediately below, the downturned lower peripheral lip 50 bears against the face of the underlying panel to establish a primary seal 54 and the underlying panel has an upper peripheral edge in the form of an upwardly turned sealing lip 55 that is positionable into engagement with the underside of the lower marginal edge portion 16 of the overlapping panel to establish a secondary seal 56. The interlocking engagement of the upper marginal edge region 15 in the hooks 48 of the overlying panel retains the lips 50, 55 in sealing engagement to substantially prevent the entry of water into the space between the overlapping upper and lower marginal edge regions 15, 16.

Figure 4:
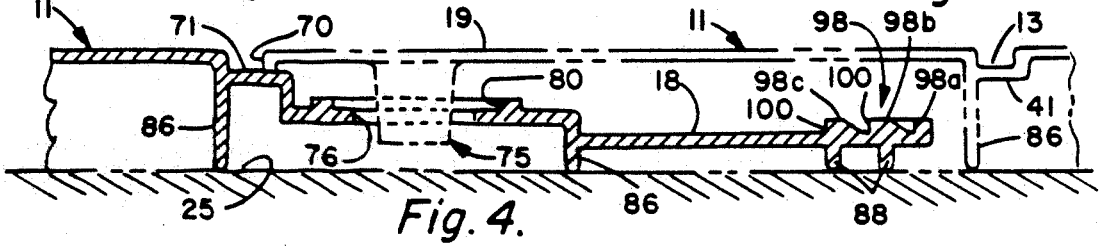

For forming a primary seal between the overlapping side marginal edge regions 18, 19 of adjacent panels 11, the stepped left-side peripheral edge of each panel is formed with a stepped rearwardly directed sealing flange 70 adapted for bearing engagement with the face of the right-hand marginal edge region 18 of the previously mounted panel. (FIGS. 1, 4 and 7). Such mounting of the panels positions the first shake 12 in each row 12*a*, 12*b*, 12*c* in closely spaced relation to the last shake of each row of the previously mounted panel. The spacing or gap 71 between the shake of adjacent panels 11 preferably should correspond substantially to that of the fixed gaps 13 between shake 12 formed in the panels (FIG. 4). preferably the fixed gaps 13 between shake 12 are of various widths, such as in the range of between ¼ inch and 5/16 inch, in order that the variance in the gap 71 between the last shake of each panel and the first shake of the adjacent panel caused by thermal expansion is substantially undetectable. To facilitate locating the left-hand peripheral edge of one panel 11 in properly overlapping relation onto the right-hand marginal edge region 18 of the previously mounted panel, the face of the right-hand marginal edge region 18 of each panel is formed with locating lines 72*a*, 72*b*, 72*c* immediately adjacent the last shake in each respective row 12*a*, 12*b*, 12*c* upon which the stepped, depending sealing flange 70 at the left-hand peripheral edge of the next mounted panel is positioned (FIG. 3).

In accordance with the invention, means are provided for positively interlocking the overlapping side marginal edge regions of adjacent panels for maintaining the overlapping side marginal edge regions in a firmly engaged sealed condition, even when the panels are mounted on slightly irregular wall and roof surfaces or are exposed to severe weather conditions, and for further preventing disruption of the seals between the overlapping top and bottom marginal edge regions. To this end, each panel 11 includes a plurality of integrally formed hooks 75 depending from the underside of the left-hand marginal edge region 19 which are adapted for positive snap action engagement with respective hook receiving apertures 76 formed adjacent the right-hand marginal edge region 18 of the underlying panel 11 and for drawing the side sealing flange 70 into firm bearing engagement with the underlying panel and for maintaining such condition. The hooks 75 each have an enlarged head 78 with a transversely oriented lip 78*a* that may be forcefully directed through the respective aperture 76 in the underlying panel 11 for engaging the underside of the panel adjacent the aperture 76 and positively retaining the overlapping side marginal edge regions 18, 19 in tight fitting relation to each other. For guiding the hooks 75 into engaged position in the respective hook receiving apertures 76 during assembly the head 78 of each hook is formed with a tapered or beveled side 79. The hooks 75 in this case are disposed in vertically spaced, laterally staggered relation, adjacent the staggered left-marginal edge region 19 of the panel. It will be seen that the interlocking engagement of the hooks 75 in hook receiving apertures 76 not only maintains the side marginal edge region seals, but further assists in preventing disorientation of the assembled mounted panels and disruption of the seals 54, 56 between the overlapping upper and lower marginal edge regions 15, The hook receiving apertures 76 preferably are of elongated configuration, each having a width slightly greater than the width of the hook 75 for allowing for horizontal thermal expansion and contraction of the interlocked panels. An uninterrupted water barrier ridge 80, in this instance of rectangular configuration, is formed in upstanding relation about each hook receiving aperture for impeding the migration of moisture that may enter between the overlapping panel portions into the hook receiving apertures 76 (FIGS. 3 and 4).

In carrying out the invention, for rigidifying the panels 11 and for providing stable mounting of the panels on the support surface 25, each panel 11 has an integrally formed rectangular grid 84 of reinforcing and support ribs on the underside thereof (FIG. 7). The grid 84 includes a plurality of horizontally extending ribs 85 formed on the underside of the panel 1l adjacent the top and bottom of each row of shake, in addition to the lower sealing flange 50. To complete the grid 84, a plurality of vertically oriented, laterally spaced ribs 86 are formed on the underside of each panel at locations adjacent the sides of the some of the shake 12, and in this instance extending rearwardly from the ridges 41 defined by the separating gaps 13 between the shake 12. The substantially rectangular grid 84 defined by the horizontal and vertical ribs 85, 86 has been found to enhance the rigidity of the panels 11 so as to resist bending and deformation during handling and upon mounting, thereby further facilitating the establishment of reliable seals about the overlapping peripheral edge portions of the panels upon mounting. To minimize material and to prevent the existence of sharp edges, the reinforcing and support ribs 85, 86 preferably have rounded ends 85*a*, 86*a*, respectively.

Figure 9:
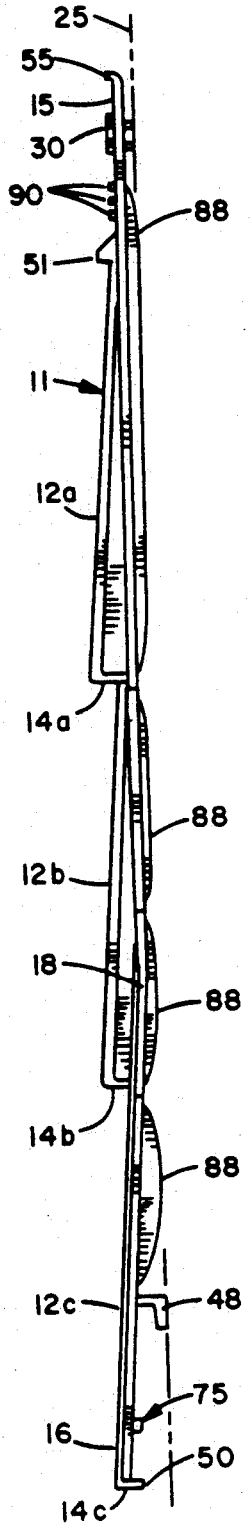
FIG. 9 is an enlarged side view of the panel shown in FIG. 7 taken in the plane of line 9—9.
Figure 10:
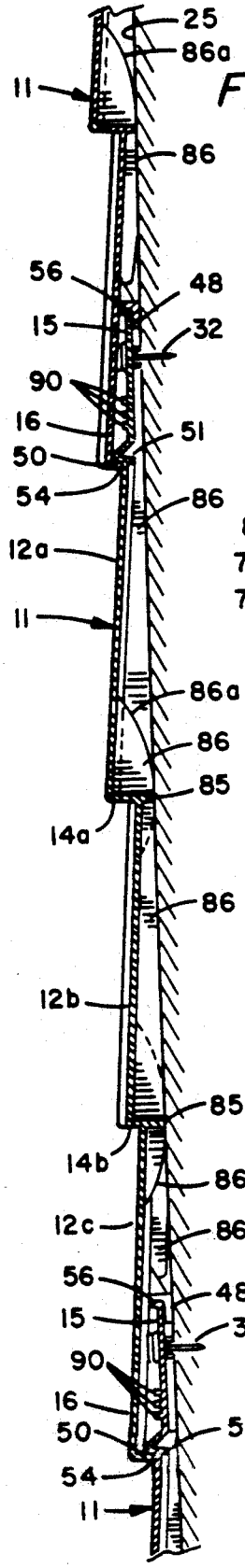
FIGS. 10–12 are enlarged fragmentary sections taken in the planes of lines 10—10, 11—11, and 12—12, respectively, in FIG. 2, illustrating the overlapping and interlocking relation between adjacent marginal edge portions of the panels.
Figure 11:
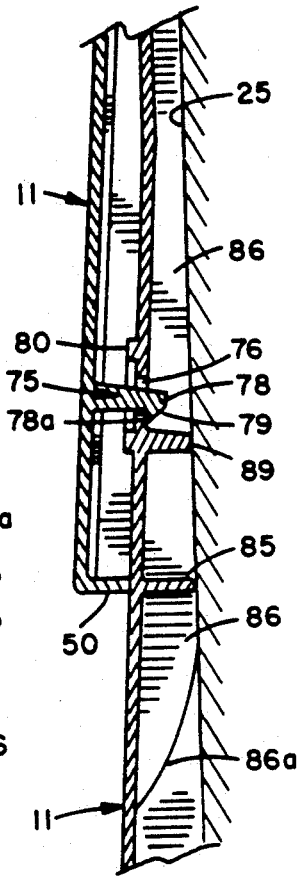

To provide stable support for the right-hand marginal edge region 18 of a mounted panel 11 during insertion of the side interlocking hooks 75 into the underlying panel, pairs of reinforcing ribs 88 are formed on the underside of the right-hand marginal edge region 18 immediately adjacent each staggered side thereof. Again, to facilitate handling and minimize material usage, the opposite ends of the support ribs 88 are rounded as shown in FIG. 9. In addition, a support or lug pin 89 is provided on the underside of each panel immediately below each hook receiving aperture 76 for providing direct support for the panel immediately adjacent the aperture as the hook of the overlapping panel is forcefully directed through the aperture during assembly. The support lugs 89 either bear upon the support surface 25 (FIG. 11) or the underlying panel (FIG. 12).

In order to prevent capillary movement of water from entering the space between the overlapping marginal edge regions of the panels 11, a plurality of horizontal, vertically spaced, water barrier ridges 90, in this instance which are 3 in number, extend in upstanding relation from the face of the upper marginal edge region 15 of each panel 11, as disclosed in the aforesaid Crick et al. application Ser. No. 07/487,910. The barrier ridges 90 preferably are discontinuous in nature, being formed with laterally spaced drainage passages 91 in vertically offset relation to each other, for impeding and slowing down the capillary movement of water upwardly between the overlapping upper and lower marginal edge regions 15, 16, while permitting effective drainage of moisture in a downward direction (FIG. 3). The barrier ridges 90, which may be on the order of 1/16 to 1/18 inch in height, preferably are disposed on upper marginal edge region 15 of each panel between the locating ledge 51 and the nail apertures 30.

To further impede the capillary or creeping movement of water upwardly along the face of the upper marginal edge region 15 into the holes pierced by the mounting nails 32 and over the upper 20 peripheral edge of the panel 11, a pair of uninterrupted, upstanding nail aperture guard ridges 95 are integrally formed in the panel immediately adjacent top and bottom sides of the elongated nail apertures 30 (FIG. 3). The illustrated nail aperture guard ridges 95 communicate with a pair of laterally spaced vertical ridges 96 which facilitate downward drainage of moisture which may accumulate between the guard ridges 95.

For impeding water migration between overlapping side marginal edge regions 18, 19 of the panels and for facilitating drainage of moisture that may enter between the overlapping marginal edge regions, a plurality of vertical and horizontal water barrier ridges 98, 99, respectively, are integrally formed on the face side of the right-hand marginal edge region 18 of each panel immediately adjacent the stepped peripheral edge of the panel 11, the vertical barrier ridges 98 being in parallel relation to the vertical sides of the stepped peripheral edge and the horizontal barrier ridges 99 being in parallel relation to the horizontal portions of the stepped peripheral edge (FIG. 3). In the illustrated embodiment, three vertical barrier ridges 98*a*, 98*b*, 98*c* are provided, with a first barrier ridge 98*a* being formed in upstanding relation immediately adjacent a respective vertical edge of the stepped section and the second and third vertical barrier ridges 98*b*, 98*c* being inwardly disposed in parallel relation to the first. The first barrier ridge 98*a* is in the form of an upturned lip and the barrier ridges 98*b*, 98*c* each have a vertical side 100 which forms a barrier for preventing liquid migration in a direction from the face side of the panel outwardly toward the peripheral edge thereof (FIGS. 3 and 4). The other side of each vertical ridges 98*b*, 98*c* is in the form of a tapered ramp extending from the top of the ridge in a downwardly inclined direction for facilitating assembly of a second panel 11 onto the right-hand marginal edge region 18 of the previously mounted panel 11 by preventing the downwardly turned sealing lip 70 on the left-hand side of the panel from catching upon the barrier ridges 98.

The transverse barrier ridges 99 are formed in pairs, with a first transverse barrier ridge 99*a* adjacent a respective transverse peripheral edge portion of the upper marginal edge region 18 and a second barrier ridge 99*b* disposed in downwardly spaced relation to the first. The second transverse barrier ridge 99*b* of each pair is connected to the lowermost end of a respective vertical barrier ridge 98*c* and extends to a position in closely spaced relation near the upper end of the inner barrier ridge 98*c* adjacent the next downwardly stepped section of the panel. To facilitate drainage of water that may enter the space between the overlapping side marginal edge regions 18, 19, the drainage openings 101 are provided in the transverse barrier ridges 99*a* at locations adjacent the bottom of the vertical barrier ridges 98. The transverse barrier ridges 99*b* preferably extend downwardly from a horizontal relatively small angle of between 10" and 15" to facilitate direction and drainage of water through drainage openings 102 defined between the end of the transverse barrier ridge 99*b* and the adjacent vertical barrier ridge 98*c*. The drainage openings 101, 102 all are disposed in horizontally offset relation to each other so as to prevent a direct vertical path for the capillary movement of water.

From the foregoing, it can be seen that the wall and roof covering of the present invention is adapted to form a secure, substantially water-resistant barrier over the support surface, even during relatively extreme adverse weather conditions. The positive interlocking engagement along the peripheral sides of the panels draw side sealing flanges into tight bearing engagement with the underlying panel, and further tend to prevent disorientation of the panel and interruption of the seals along the top and bottom overlapping marginal edge regions. The synthetic panels further have improved structural rigidity which tend to prevent bending and deformation during handling and upon mounting. The panels, nevertheless, are of relatively simple construction, and lend themselves to economical manufacture and ease of mounting with a realistic and naturally aesthetic appearance.

We claim:

1. A wall covering for mounting on a support surface comprising a plurality of panels each having a body portion formed with simulated building elements, said panels each having right-side and left-side marginal edge regions, said panels being mountable on said support surface in a plurality of horizontal courses with side marginal edge regions of adjacent panels in overlapping relation, said overlapping side marginal edge regions defining engageable sealing means therebetween, and said overlapping side marginal edge region of each panel having integrally formed locking hooks depending from an underside thereof for engaging an underside surface of an underlying side marginal edge region of the adjacent panel for positively securing the overlapping side marginal edge regions together and for maintaining said side marginal edge region sealing means in engaged relation.

2. The wall covering of claim 1 in which said sealing means includes an integrally formed sealing lip depending from the underside of the panel for engagement with the face side of the underlying marginal edge region of the adjacent panel.

3. The wall covering of claim 1 including a grid of integrally formed ribs on the underside of each panel for supporting and reinforcing the panel.

4. The wall covering of claim 9 in which said grid comprises a plurality of horizontal and vertically extending ribs which define a rectangular reinforcing and supporting grid.

5. The wall covering of claim 4 in which said horizontal reinforcing and supporting ribs are disposed on the underside of said panel at locations corresponding to the top and bottom ends of the simulated building element.

6. The wall covering of claim 5 in which said simulated building elements are rows of simulated shakes with adjacent shake of each row separated by a small gap, and said vertical reinforcing and supporting ribs are disposed on an underside of said panel at the location of the gaps between adjacent shake.

7. The wall covering of claim 4 in which said reinforcing and support ribs each are rounded at opposite ends.

8. The wall covering of claim 1 in which said panels each have upper and lower substantially horizontal marginal edge regions and are mounted on said support surface with the lower marginal edge regions of the panels in one course overlapping the upper marginal edge regions of the panels in the course immediately therebelow, and said overlapping upper and lower marginal edge regions defining engageable sealing means therebetween.

9. The wall covering of claim 1 in which said panels each have upper and lower substantially horizontal marginal edge regions and are mounted on said support surface with the lower marginal edge regions of the panels in one course overlapping the upper marginal edge regions of the panels in the course immediately therebelow, and said upper marginal edge region of each panel being formed with a plurality of water barrier ridges for preventing the upward migration of water between said overlapping upper and lower marginal edge regions.

10. The wall covering of claim 9 in which said water barrier ridges are discontinuous so as to impede upward water movement while allowing drainage of water downwardly through said ridges.

11. The wall covering of claim 9 in which said overlapping side marginal edge regions define a plurality of water barrier ridges for impeding outward movement of water toward the peripheral edge of the underlying side marginal edge region.

12. The wall covering of claim 1 in which said panels each have upper and lower substantially horizontal marginal edge regions and are mounted on said support surface with the lower marginal edge regions of the panels in one course overlapping the upper marginal edge regions of the panels in the course immediately therebelow, said panels each being formed with a plurality of downwardly directed hooks along a lower underside thereof, and said downwardly directed hooks each being engageable with the upper marginal edge region of the underlying panel.

13. A wall covering for mounting on a support surface comprising a plurality of panels each having a body portion formed with simulated building elements, said panels each having right-side and left-side marginal edge regions, said panels being mountable on said support surface in a plurality of horizontal courses with side marginal edge regions of adjacent panels in overlapping relation, said overlapping side marginal edge regions defining engageable sealing means therebetween, means between said overlapping side marginal edge regions for positively interlocking said overlapping side marginal edge regions for drawing together and maintaining said side marginal edge region sealing means in engaged relation, said interlocking means including a plurality of integrally formed hooks depending from an underside of the side marginal edge region of each panel for insertion through respective receiving apertures formed in the underlying side marginal edge region of the adjacent panel.

14. The wall covering of claim 13 in which said hooks each have an enlarged head for passage through the respective hook-receiving aperture of the underlying marginal edge region of the adjacent panel for engagement with the underside of said underlying marginal edge region.

15. The wall covering of claim 14 in which said hooks each have a head with a transversely directed lip for engaging the underside of the underlying marginal edge region of the adjacent panel.

16. The wall covering of claim 13 in which said hooks and said hook-receiving apertures for each panel are vertically spaced adjacent respective side marginal edge regions of the panel.

17. The wall covering of claim 13 in which said hook receiving apertures each have a width greater than the width of the hook for permitting thermal expansion and contraction of adjacent interlocked panels.

18. The wall covering of claim 13 in which each said panel is formed with a plurality of horizontal rows of simulated building elements, said rows being laterally offset from each other so that said side marginal edge regions of each panel have staggered peripheral edges, and including a plurality of said hooks and hook receiving apertures disposed in vertically and laterally offset relation to each other.

19. A wall covering for mounting on a support surface comprising a plurality of panels each having a body portion formed with simulated building elements, said panels each having right-side and left-side marginal edge regions, said panels being mountable on said support surface in a plurality of horizontal courses with side marginal edge regions of adjacent panels in overlapping relation, and said panels each having at least one integrally formed hook depending from a side marginal edge region for passage through a respective hook-receiving aperture formed in an underlying side marginal edge region of the adjacent panel for positively securing the overlapping side marginal edge regions together.

20. The wall covering of claim 19 in which each panel has a plurality of said hooks which are vertically spaced for engagement with respective vertically spaced hook-receiving apertures in the underlying side marginal edge region of the adjacent panel.

21. The wall covering of claim 20 in which each panel has an uninterrupted water barrier ridge extending upwardly from the side marginal edge region in surrounding relation about each hook-receiving aperture for impeding the migration of moisture into the hook-receiving aperture that might enter between the overlapping side marginal edge regions.

22. The wall covering of claim 20 in which said hooks and said hook-receiving apertures for each panel are vertically spaced adjacent respective side marginal edge regions of the panel, and said hook receiving apertures each have a width greater than the width of the hook for permitting thermal expansion and contraction of adjacent interlocked panels.

23. The wall covering of claim 20 in which panels each have upper and lower substantially horizontal marginal edge regions and are mounted on said support surface with the lower marginal edge regions of the panels in one course overlapping the upper marginal edge regions of the panels in the course immediately therebelow, said panels each are formed with a plurality of downwardly directed hooks along a lower underside thereof, said downwardly directed hooks each being engageable with the upper marginal edge region of the underlying panel, and said side marginal edge region hooks being effective for retaining said panels in assembled position and preventing disengagement of said downwardly directed hooks from the upper marginal edge region of the underlying panel.

24. The wall covering of claim 20 in which each panel is formed with lugs on a rear side thereof, said lugs each being in close proximity to said hook-receiving apertures for supporting the panel during positioning of said hooks through said apertures.

25. The wall covering of claim 24 in which at least some of said lugs engage the support surface upon which said wall covering is mounted.

26. The wall covering of claim 24 in which at least some of said lugs engage the underlying panel.

27. The wall covering of claim 20 including a plurality of integrally formed, laterally spaced ribs extending rearwardly adjacent the peripheral edge of the panel for supporting the panel during positioning of said hooks through said aperture.

28. The wall covering of claim 19 in which each hook has an enlarged head for passage through the respective hook-receiving aperture of the underlying marginal edge region of the adjacent panel for engagement with the underside of said underlying marginal edge region.

29. The wall covering of claim 28 in which the enlarged head of each hook has a beveled end for facilitating forceful insertion through the respective hook receiving aperture.

30. The wall covering of claim 19 including a plurality of horizontally and vertically extending ribs on the underside of each panel which define a rectangular reinforcing and supporting grid.

31. The wall covering of claim 19 in which panels each have upper and lower substantially horizontal marginal edge regions and are mounted on said support surface with the lower marginal edge regions of the panels in one course overlapping the upper marginal edge regions of the panels in the course immediately therebelow, said upper marginal edge region of each panel being formed with a plurality of water barrier ridges for preventing the upward migration of water between said overlapping upper and marginal edge regions, and said overlapping side marginal edge regions defining a plurality of water barrier ridges for impeding outward movement of water toward the peripheral edge of the underlying side marginal edge region.

32. The wall covering of claim 19 in which each said panel is formed with a plurality of horizontal rows of simulated building elements, said rows being laterally offset from each other so that said side marginal edge regions of each panel have staggered peripheral edges, and including a plurality of said hooks and hook receiving apertures disposed in vertically and laterally offset relation to each other.

* * * * *